United States Patent [19]

Rangwala et al.

[11] Patent Number: 4,537,335

[45] Date of Patent: Aug. 27, 1985

[54] FILLER MEANS FOR CHARGING CONTAINERS

[75] Inventors: Badruddin K. Rangwala, Farmington Hills; Toney S. Flack, Livonia, both of Mich.

[73] Assignee: Ex-Cell-O Corporation, Troy, Mich.

[21] Appl. No.: 620,581

[22] Filed: Jun. 14, 1984

Related U.S. Application Data

[63] Continuation of Ser. No. 382,889, May 28, 1982, abandoned.

[51] Int. Cl.[3] ..... F16K 31/12

[52] U.S. Cl. ..... 222/496; 137/510; 141/392

[58] Field of Search ..... 141/392, 302; 222/449, 222/453, 491, 495–497, 518, 547, 425; 137/494, 506, 509, 510, 533.15; 239/453, 456, 459

[56] References Cited

U.S. PATENT DOCUMENTS

| | | | |
|---|---|---|---|
| 2,391,808 | 12/1945 | Vincent | 137/510 |
| 2,987,082 | 6/1961 | Schaub | 222/496 |
| 3,097,671 | 7/1963 | Bonetti et al. | 222/496 |
| 3,267,971 | 8/1966 | Mueller | 141/392 |
| 4,140,089 | 2/1979 | Kueny et al. | 137/510 |

FOREIGN PATENT DOCUMENTS

| | | | |
|---|---|---|---|
| 161397 | 4/1933 | Switzerland | 137/510 |
| 950252 | 2/1964 | United Kingdom | 239/453 |

*Primary Examiner*—H. Grant Skaggs
*Attorney, Agent, or Firm*—John P. Moran

[57] ABSTRACT

The drawings and description disclose a liquid filler arrangement including upper and main bodies and a lower sleeve nozzle, with a diaphragm assembly mounted between the main and upper bodies and an inlet formed in the side of the main body. Combined valve and orifice mechanism is operatively positioned substantially at the juncture of the main body and the sleeve nozzle, and one of a diffuser, a lip seal, or a valve is located at the bottom end of the sleeve nozzle, each of which supports a column of liquid product, the diffuser and lip seal by capillary action, and the valve by virtue of being closed. Upon a measured volume of liquid product being pumped into the side inlet by a remote timed piston device, an equivalent measured volume is discharged from the sleeve nozzle through its diffuser or opened lip seal or valve into a container which may be mounted around the sleeve nozzle and filled as it is being pulled from around the sleeve nozzle by a suitable external arrangement.

14 Claims, 4 Drawing Figures

FILLER MEANS FOR CHARGING CONTAINERS

This application is a continuation of application Ser. No. 382,889, filed May 28, 1982, now abandoned.

TECHNICAL FIELD

This invention relates generally to filler valves for liquids and, more particularly, to a diaphragm actuated filling valve including a sleeve nozzle which is adaptable to being inserted into a container to fill the container with a liquid as the container and sleeve nozzle are separated from one another at a predetermined rate.

BACKGROUND ART

Heretofore, container filler mechanisms have generally included nozzle means disposed above an open-top container which drop the liquid product the full depth of the container, resulting in the formation of foam when the container is full, which tends to interfere with the top sealing operation. Other known filler units are adapted to either being inserted into a container or to having a container fitted around the filler unit in order to progressively fill the container as the filler unit is removed relative thereto, thereby tending to minimize the formation of foam. Hereinafter, such filler units will be referred to "bottom-up" filler valves.

DISCLOSURE OF THE INVENTION

A general object of the invention is to provide an improved bottom-up type filler valve.

Another object of the invention is to provide a diaphragm actuated, bottom-up filler valve.

A further object of the invention is to provide a diaphragm actuated, bottom-up filler valve including interchangeable sleeve nozzles suitable, respectively, for milk or clear juice products and buttermilk or pulpy products such as orange juice.

Still another object of the invention is to provide a diaphragm actuated bottom-up filler valve including interchangeable sleeve nozzles wherein an upper valving means may serve as a combination valve and orifice in one embodiment and an orifice only in another embodiment, while a lower valving means performs a flow directing and a flow directing and sealing function, respectively, in the two embodiments.

A still further object of the invention is to provide a liquid filler arrangement including upper, main and lower bodies, with a diaphragm assembly mounted between the main and upper bodies, an inlet into the side of the main body, combined valve and orifice means operatively positioned substantially at the juncture of the main and lower bodies, and one of a diffuser, a lip seal, or a valve at the bottom end of the lower body, each of which supports a column of liquid product, the diffuser and lip seal by capillary action, and the valve by virtue of being closed, until a measured volume of liquid product is pumped into the side inlet by a remote timed piston or other suitable means, whereupon an equivalent measured volume is discharged from the lower body through its diffuser or valve into a container which may be mounted around the lower body and filled as it is being pulled from around the lower body by suitable external means.

These and other objects and advantages will become more apparent when reference is made to the following description and accompanying drawings.

BEST MODE OF CARRYING OUT THE INVENTION

Figure 1:
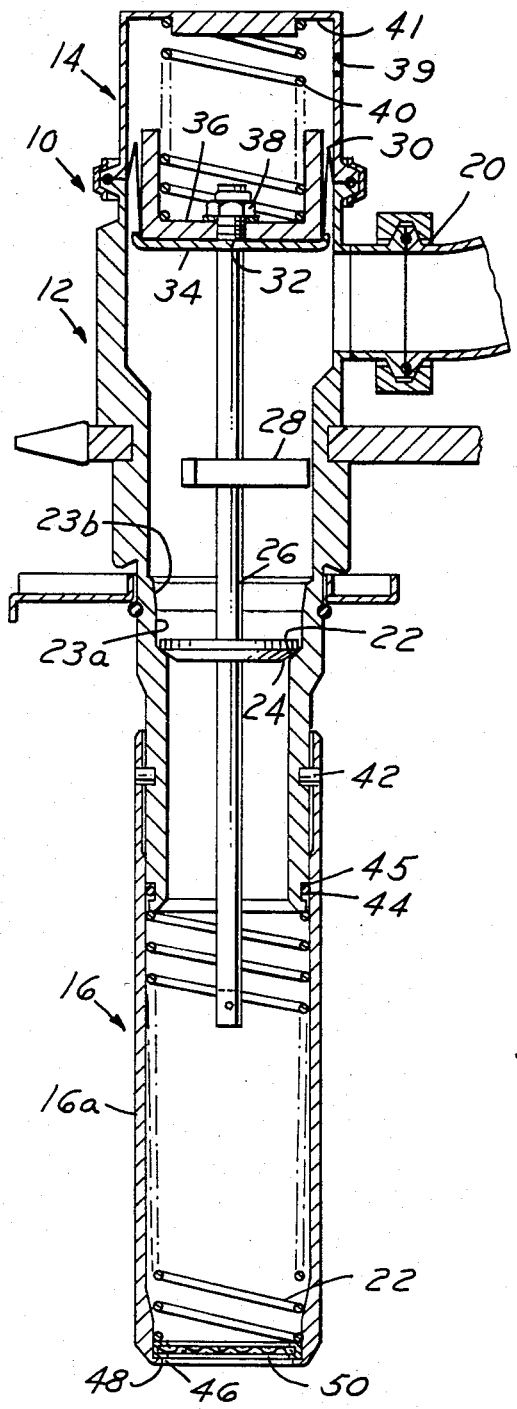
FIG. 1 is a side cross-sectional view of the invention.

Referring now to the drawings in greater detail, FIG. 1 illustrates a filler valve assembly 10 including a main body section 12, an upper section 14 and a lower section 16. The main body section 12 includes a cylindrical housing 18 having an inlet connection 20 formed in a side wall adjacent the upper end thereof. A frusto-conically shaped seat 22 is formed on the inner lower portion of the body section 12 just below an orifice area consisting of a substantially cylindrical surface **23*a* adjacent the seat 22, and a steeper frusto-conical surface 23*b* above the surface 23*a*, for a purpose to be described. A valve member 24 having a frusto-conically shaped peripheral edge is mounted on a valve rod 26 for axial movement within the body section 12. A guide member 28 is formed on the valve rod 26 for cooperation with the housing 18 to retain the valve rod in axial alignment in the section 12 such that, when closed, the valve member 24 engages the seat 22** in a sealing relationship.

A lightweight diaphragm 30 preferably formed of a suitable fabric material covered with a rubber compound, such as silicon, is confined at its peripheral edge between the upper and main body sections 14 and 12, respectively. The upper end of the valve rod 26 extends through an opening 32 formed in the center of the diaphragm 30. The latter is confined between a retainer flange 34 formed on the valve rod 26 and a centrally perforated cup-shaped piston member 36 secured around the valve rod and against the diaphragm 30 by a locknut 38. A vent hole 39 is formed in a wall of the upper body section 14. A spring 40 is mounted between the member 36 and an end wall 41 of the upper body section 14. If desired for particular products, a pneumatic or other type pressure means may be used in lieu of, or in addition to, the spring 40 to assure faster response time.

Three types of lower body section 16 are interchangeably connected to the housing 18 of the main body section 12 via a suitable snap-on pin and groove or bayonet-type connection 42. An "O" ring seal 44 is mounted between the lower and main body sections in a groove 45 formed in the main body section. One type of lower body section 16, which shall hereinafter be referred to as sleeve nozzle **16*a*, includes an outlet opening 46 defined by an internal flange 48 formed at the lower end thereof. A diffuser 50 is removeably mounted on the inner surface of the flange 48 and retained thereagainst by a spring 52 mounted between the diffuser and the lower edge of the main body section 12. This sleeve nozzle 16*a* is preferred for use with regular milk and clear juices. The diffuser 50 may consist of a screen pack including a plurality of openings (not shown) small enough to hold liquid thereabove by virtue of capillary action until such time as a pressure is directed to the liquid. It should be noted that a sleeve nozzle of the type described is adaptable to the above referenced bottom-up type filling arrangements for containers, such as that represented at 53 and shown surrounding the sleeve nozzle 16***a*.

The second type of lower body section 16, which shall hereinafter be referred to as sleeve nozzle 16*b*, shown in FIG. 2, includes an outlet opening 54 defined by an internally tapered flange 56 formed at the lower end thereof. A conically shaped enlargement 57 formed on the lower end of a rod 58 terminates in a cylindrical lip seal surface 60. The rod 58 includes a flat extension 62 at its upper end adapted to being mounted in a slot 64 formed in the end of the upper valve rod 26 by a pin 66 extended through aligned openings 68 and 70 formed in the respective rods 26 and 58. A guide member 72 is formed on the rod 58 for cooperation with the wall of the lower section 16 such that the lip seal surface 60 is aligned so as to fit just inside the outlet opening 54 in a capillary seal relationship therewith. A spherical extension 74 is formed on the outer face of the lip seal surface 60 to aid in shaping the liquid flow pattern when the lip seal surface 60 is open with respect to the opening 54. The sleeve nozzle 16*b* is preferred for use with heavy and pulpy products, such as buttermilk and orange juice.

The third type of lower body section 16, which shall hereinafter be referred to as sleeve nozzle 16*c*, shown in FIG. 3, includes a valve 76 formed on the end of the rod 58 and which cooperates with a seat 78 formed at the lower end of the sleeve nozzle. In this embodiment when the valve 76/78 is closed, the upper valve 22/24 is open, serving as an orifice. The spherical extension 74 now serves as the sealing surface in addition to shaping the liquid flow pattern.

In operation, the valve assembly 10 is first primed such that the main body 12 and the lower nozzle section 16 are filled with a selected liquid product. The assembly is then ready for a production run, whereupon a measured volume of fluid product is communicated from a tank (not shown) via a timed piston or other suitable arrangement (not shown) to the inlet connection 20 and, thence, into the main body section 12. Upon entering the latter section, the assembly consisting of the diaphragm 30, the retainer flange 34 and the piston member 36 are urged upwardly against the force of the spring 40, the air therein being purged through the vent hole 39. This causes the valve member 24 to be lifted from the seat 22, within the orifice surface 23*a* for small volumes, such as half pints, or upwardly within the orifice surface 23*b* for larger volumes, such as pints or quarts. This causes the incoming product to be directed through the valve area 22/24, thereby urging an equivalent measured volume of fluid which was confined in the lower and main body to be urged through the diffuser 50 sections 16 and 12 into a selected size container positioned therebelow by the usual indexing conveyor (not shown). Conventional external means may be employed to raise and lower the container 53 relative to the sleeve nozzle 16. Once the pumping stroke is completed, the spring 40 urges the diaphragm 30 and, hence, the valve 24 downwardly until the latter once again is seated on the seat 22. The incoming liquid replaces the volume of liquid in the main and lower body section 12 and 16, ready for the next cycle.

Similarly, a fluid product is contained in the main body 12 and between the valve member 24 and the lower lip seal surface 60 of the sleeve nozzle 16*b* as a result of the capillary seal effect between the lip seal surface 60 and the adjacent opening 54. The operation is the same as described above relative to the sleeve nozzle 16*a* once a timed pulse of liquid is communicated through the inlet connection 20.

When the sleeve nozzle 16*c* is used, there likewise is a full column of liquid product above the closed bottom valve 76/78. When a measured volume of new liquid product is pumped into the main body 12, the resultant force against the diaphragm assembly 30/34/36 lifts the rods 26 and 58 and, hence, opens the lower valve 76/78 to discharge the designated volume of fluid into the awaiting container, as the latter is lowered from around the sleeve nozzle 16*c*.

Figure 4:
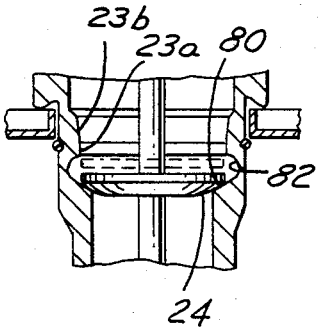
FIG. 4 is a fragmentary cross-sectional view of an alternate arrangement of the valve and seat portion of the FIG. 1 structure.

Referring now to FIG. 4, it may be noted that the main body section 12 includes the frusto-conically shaped valve 24 and the valve rod 26 as in the FIG. 1 arrangement, and a valve seat 80 which differs from the valve seat 22 in that the frust-conical surface thereof extends into the wall of the main body housing 18 to blend into an annular groove 82 forming an annular cavity in the wall of the housing intermediate the seat 80 and the cylindrical surface 23*a*. Such an arrangement is compatible with the function of the diffuser 50 of the FIG. 1 sleeve nozzle 16*a*. An advantage resulting from having the annular cavity 82 is that the vertical travel distance of the valve 24 and valve rod 26 is substantially reduced, thereby resulting in the valve 24 being more responsive for both its closing and opening functions, the closing action functioning on the order of a "sink stopper" effect, i.e., the suction and/or inertial effects of the moving liquid serving to speed up the closing. An additional advantage is minimizing wear of the diaphragm due to the reduced flexing thereof.

Figure 2:
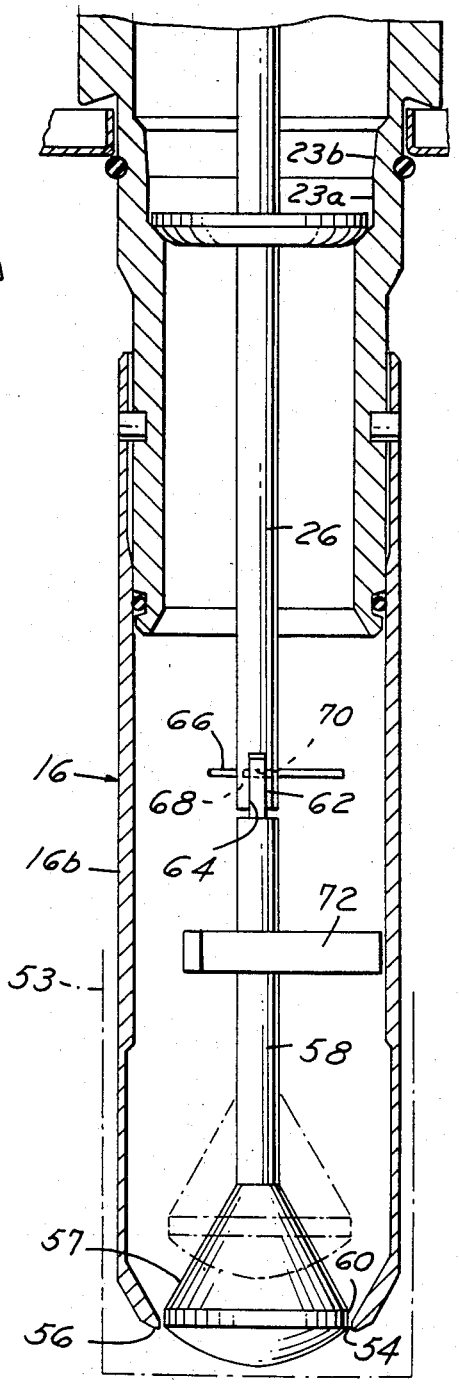
FIGS. 2 and 3 are cross-sectional views of alternate nozzle arrangements which may be interchanged with the lower body portion of the FIG. 1 structure.
Figure 3:
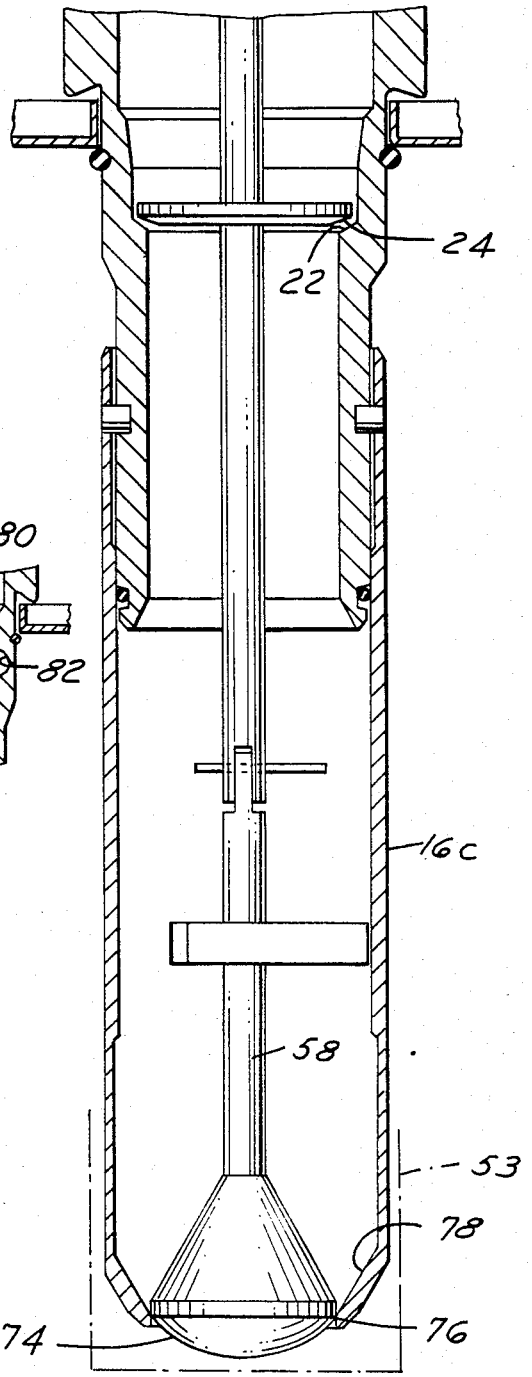

It should be noted that, while the annular cavity 82 alteration would not be compatible with the lip seal arrangement of the FIG. 2 embodiment, the sleeve nozzle 16*c* and valve 76 and seat 78 of the FIG. 3 embodiment could be interchanged with the sleeve nozzle 16*a* without any ill effect.

INDUSTRIAL APPLICABILITY

It should be apparent that the invention provides a versatile filler valve arrangement for various liquid products, as well as for various size containers, and one which is highly efficient in operation so as to be capable of meeting the fast production requirements of today's conventional forming, filling and sealing machines.

While but three general embodiments of the invention have been shown and described, other modifications thereof are possible.

The embodiments of the invention in which an exclusive property or privilege is claimed are defined as follows:

1. A filler valve assembly for filling containers with liquid products, said filler valve assembly comprising an upper body; a main body; a pressure-responsive assembly mounted so as to separate said upper and main bodies; spring means mounted between said pressure-responsive assembly and the upper end of said upper body; an inlet connection and opening in a side of said main body; a sleeve nozzle connected to the lower end of said main body; a valve seat formed at the lower end of said sleeve nozzle; a valve connected by rod means to said pressure-responsive assembly; orifice means formed in said main body, said orifice means including a cylindrical surface formed in said main body for a predetermined height and an adjacent member secured to said rod means to accommodate the flow therepast of a selected volume of fluid products, and a frust-conical surface formed just above said cylindrical surface for a second predetermined height for cooperation with said adjacent member secured to said rod means to accommodate the flow therepast of a larger selected volume of fluid products; said valve being urged by said spring means into engagement with said valve seat until such time as a measured volume of fluid product is communicated from a source of fluid product through said inlet opening to said main body, to thereby urge said pressure-responsive assembly upwardly against the force of said spring means and thereby lift said valve from said valve seat and providing the pressure to vary said orifice means as required to correspond to the measured volume per unit time and to force an equivalent measured volume of fluid product through the space between said valve and valve seat into said containers.

2. The filler valve assembly described in claim 1, wherein said pressure-responsive assembly includes a diaphragm confined between a retainer flange and a piston member secured adjacent the upper end of said rod means just above said inlet opening, and retained at its peripheral edge between said upper and main bodies, said spring means being mounted between said piston member and said upper end.

3. The filler valve assembly described in claim 2, wherein said diaphragm consists of a fabric material covered with a rubber compound.

4. The filler valve assembly described in claim 3, wherein said rubber compound is silicon.

5. The filler valve assembly described in claim 1, wherein said sleeve nozzle is of a predetermined length and is releasably connected to said main body.

6. The filler valve assembly described in claim 5, wherein said filler valve and sleeve nozzle are particularly adaptable to being used as a "bottom-up" type filler arrangement, thereby after said sleeve nozzle is inserted into said respective containers, filling said containers while said sleeve nozzle is being relatively removed from within said respective containers.

7. A filler valve assembly for filling containers within liquid products, said filler valve assembly comprising an upper body portion and a main body portion, a pressure-responsive assembly reciprocally mounted between said upper body and main body portions, spring means mounted between said pressure-responsive assembly and the upper end of said upper body, an inlet connection and opening in a side of said main body, a valve seat formed in said main body, an orifice formed just above said valve seat, said orifice consisting of a cylindrical surface formed for a predetermined height and a frusto-conical surface formed just above said cylindrical surface for a second predetermined height to accommodate the flow therepast of measured volumes of fluid products, a first valve member connected by rod means to said pressure-responsive assembly and mounted for reciprocal cooperation within said orifice, a sleeve nozzle connected to the lower end of said main body, an internally tapered flange formed at the lower end of said sleeve nozzle, a second valve member connected by said rod means to said pressure-responsive assembly for cooperation with said internally tapered flange, only one of said first and second valve members being urged by said spring means into engagement with one of said respective valve seat and internally tapered flange until such time as a measured volume of fluid product is communicated from a source of fluid product through said inlet opening to said main body, to thereby urge said pressure-responsive assembly upwardly against the force of said spring means and the first and second valve members away from said respective valve seat and internally tapered flange with said first valve member being moveable within said orifice a distance corresponding to the measured volume per unit time while forcing an equivalent measured volume of fluid product through the space between said second valve member and said internally tapered flange into the containers.

8. The filler valve assembly described in claim 7 and an annular chamber formed adjacent said cylindrical surface for reducing travel distance of said valve for said selected volume of fluid products and reducing opening and closing times therefor.

9. The filler valve assembly described in claim 7 wherein said internally tapered flange and said second valve member serve as capillary seal means positioned at the lower end of said sleeve nozzle for retaining a column of fluid product thereabove until said measured volume of fluid product is communicated to said main body.

10. The filler valve assembly described in claim 9, wherein second valve means includes an enlarged member formed on the lower end of said rod means in a lip seal relationship with said internal tapered flange of said sleeve nozzle.

11. The filler valve assembly described in claim 7, wherein a column of fluid product is retained intermediate said first and second valve members until said measured volume of fluid product is communicated from said source of fluid product through said inlet opening to said main body to raise said pressure-responsive assembly.

12. The filler valve assembly described in claim 11, wherein said second valve member and said internally tapered flange serve as a capillary seal means and said first valve member, said valve seat and said orifice serve as a combined valve and variable orifice means.

13. The filler valve assembly described in claim 11, wherein said second valve member and said internally tapered flange serve as a valve means and said first valve member and said orifice serve as a variable orifice means only.

14. The filler valve assembly assembly described in claim 11, and a spherical extension formed on the outer face of said second valve member to aid in shaping the liquid flow pattern when said second valve member is lifted above said internally tapered flange.

* * * * *